United States Patent [19]

Polson

[11] 4,236,982

[45] Dec. 2, 1980

[54] ELECTROLYSIS OF LEAD AZIDE

[75] Inventor: Jack R. Polson, Burlington, Iowa

[73] Assignee: The United States of America as represented by the Secretary of the Army, Washington, D.C.

[21] Appl. No.: 75,565

[22] Filed: Sep. 14, 1979

[51] Int. Cl.[3] ..... C25C 1/18

[52] U.S. Cl. ..... 204/116

[58] Field of Search ..... 204/116

[56] References Cited

U.S. PATENT DOCUMENTS 2,352,625 7/1944 Gottlieb et al. ..... 204/116

*Primary Examiner*—R. L. Andrews

*Attorney, Agent, or Firm*—Nathan Edelberg; Robert P. Gibson; A. Victor Erkkila

[57] ABSTRACT

There is disclosed a process of disposing of lead azide by subjecting lead azide to electrolysis in an aqueous alkali electrolyte to recover metallic lead at the cathode. The electrolyte contains, on a weight basis, from about 10% to 20% sodium hydroxide and preferably from about 0.2 % to about 0.6% rosin powder and about 5% sodium-potassium tartrate. The preferred reaction temperature is about 180° F. The preferred voltage is about 2 to 8.5 and the preferred current density is about 0.085 amperes per square inch of electrode. The preferred process results in the destruction of about 25 to 30 pounds of lead azide per hour.

17 Claims, 7 Drawing Figures

ELECTROLYSIS OF LEAD AZIDE

GOVERNMENT RIGHTS

The invention described herein may be manufactured, used, and licensed by the Government for Governmental purposes without the payment to us of any royalties thereon.

BACKGROUND OF THE INVENTION

Lead azide is a preferred detonator for military uses. During wartime and periods of unrest large stores of lead azide are stockpiled in the event it becomes necessary to use. Eventually, there comes a time when the need for lead azide diminishes and excess stores must be disposed of without causing environmental pollution. The most desirable result sought in the disposal of lead azide is to recover the lead in a commercially viable form by a process which is practical, efficient, safe, economical and pollution free.

Methods of disposing of lead azide now in use, the so-called chemical "Kill Methods" are uneconomical because relatively costly chemicals and processing steps are used. For example, using ammonium acetate-sodium nitrate-acetic acid for "Killing" lead azide costs about $25.00 a pound, whereas the use of sodium hydroxide costs about 25 cents a pound. We have found that about a ten-fold increase in economy can be achieved by utilizing electrolysis to recover lead from lead azide.

SUMMARY OF THE INVENTION

This invention relates to a method of disposing of lead azide by subjecting the lead azide to electrolysis and recovering the lead which plates out on the cathode. More particularly, this invention relates to a method of subjecting lead azide to electrolysis using a basic electrolysis solution and stainless steel or lead electrodes. Nitrogen is evolved at the anodes.

The preferred electrolysis solution (electrolyte) is sodium hydroxide having a concentration of from 10% to 20%. The physical form of the lead recovered can be spongy or dense. The dense lead is preferred because it adheres well to the cathode. The use of from about 0.2% to about 0.6% by weight rosin powder and about 5% by weight sodium-potassium tartrate in the electrolyte, in addition to the sodium hydroxide, is preferred since it inhibits the formation of lead oxide and aids in the plating of dense lead. The preferred temperature of operation is about 180° F. Voltages of from about 2 to 8.5 can be used. The preferred current density is about 0.085 amperes per square inch, using from about 2.3 to 3.0 volts and about 1000 to 3000 amperes. In order to insure that the lead deposited on the cathode adheres well, the cathode can be etched. The process of this invention can accomplish the destruction of about 10 to 30 pounds of lead azide per hour with the preferred conditions resulting in the destruction of about 25 to 30 pounds of lead azide per hour.

DETAILED DESCRIPTION OF THE INVENTION

Figure 1:
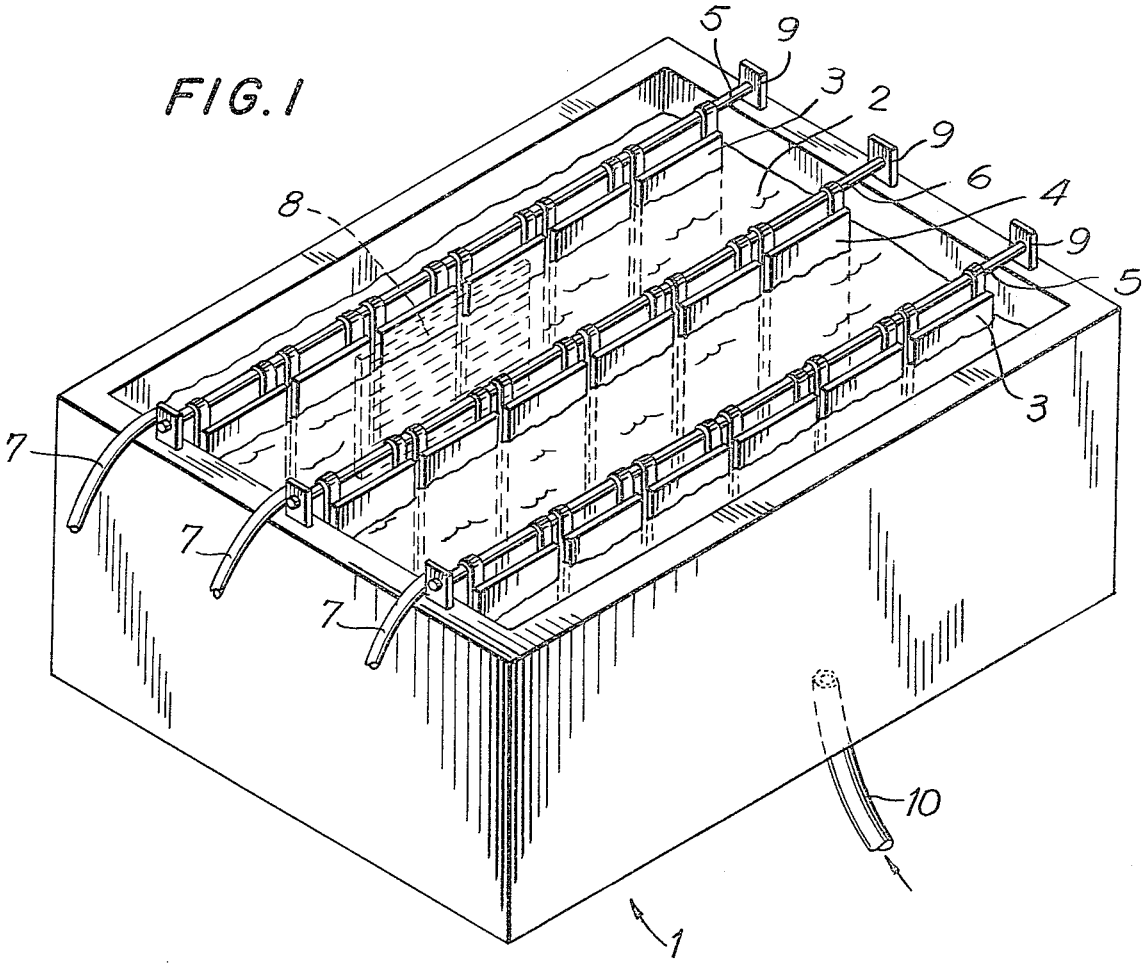
FIG. 1 is a schematic drawing in perspective of the electrolysis apparatus used in the process of this invention.

The present invention is based on the discovery that the lead component of lead azide can be recovered by subjecting the lead azide in aqueous alkaline solution to electrolysis.

In order to conduct the electrolysis in a most efficient manner and obtain high conversion rates of lead azide to lead in a sufficient time to make the process practical for not only disposing of lead azide safely, but also for obtaining lead in a form which can be marketed, it is necessary to utilize reaction conditions and materials which contribute to optimum results.

In order to be economically feasible, it is necessary to destroy at least 25 pounds of lead azide per hour by electrolysis. In order to do this, the lead azide is chemically dissociated in an electrolyte, then subjected to electrolysis according to the following equations:

Reactions

No. 1.—Dissolving Lead Azide in NaOH Solution $$Pb(N_3)_2+3NaOH+H_2O \rightarrow Pb(OH)_2+2NaN_3.+NaOH+H_2O$$

No. 2.—Electrolysis-Simplified $$Pb^{++} + 2N_3^- + 2H_2O \rightarrow Pb + 2H_2\uparrow + 3N_2\uparrow + O_2\uparrow$$

No. 3.—Individual Electrolysis Reactions cathode anode

A. Cathode $$Pb^{++}+2e^- \rightarrow Pb$$

$$4\,H_2O+4e^- \rightarrow 2H_2\uparrow +4OH^-$$

B. Anode $$2N_3^- \rightarrow 3N_2+2e^-$$

$$2H_2O \rightarrow O_2+4H^++4e^-$$

The concentration of the sodium hydroxide in the electrolysis solution is important since it contributes to the efficiency of the process and aids in producing the preferred dense lead rather than the sponge lead. It was found that while concentrations of 2%, 5%, 10% and 20% sodium hydroxide could support electrolysis of lead azide, 2% and 5% solutions showed a heavy lead oxide formation at the anode. This is undesirable since the efficiency of the process suffers. In addition, the lead oxide fouls the electrolysis tank inner surfaces and interferes with the heating coils. As the concentration of the sodium hydroxide increases, the formation of lead oxide decreases, and at 20% concentration it is substantially eliminated. No further improvement is manifested at higher concentrations. Therefore, the preferred concentrations of sodium hydroxide are from 10% to 20% with the most preferred being 20%.

The identity of the electrolyte is important since other known electrolytes, e.g. sodium chloride, acetic acid and the like, are unsatisfactory. Other alkali metal hydroxides such as potassium hydroxide can be used instead of the preferred sodium hydroxide.

It has been found that the addition of small amounts of rosin in powder form and sodium-potassium tartrate (SPT) to the electrolysis solution will substantially completely inhibit the formation of lead oxide. The amounts of rosin and SPT in the electrolyte are not critical to the operation of the process of this invention however, it is preferred to use no more than about 0.6% by weight rosin and about 5% by weight SPT. The most preferred amounts are 0.2% by weight rosin and 5% by weight SPT.

The particular electrodes used have a significant effect on the process. The electrodes must be of a material that will not cause secondary reactions with the lead but will plate out the lead on the cathode in a form which is easy to recover. The electrodes must be insoluble in the electrolyte. Typical electrodes are are platinum, stainless steel, lead and copper. Preferred for use in this invention is stainless steel since it is inert to the electrolyte and lead plates on it readily but does not adhere so strongly that it cannot be removed. Lead can also be used satisfactorily but it does not result in as high a yield under the conditions of this process.

The relative surface areas of the cathode and anode and the current density applied as well as the voltage has an effect on the yields of lead. Increasing the voltage increases the yield. However, if the amperage is too high, then the results are poor. Generally, a voltage of from about 2 to about 3 is satisfactory if the amps per square inch are from about 0.018 to about 0.1. The preferred current density is about 0.046 to 0.085 amps per square inch.

The relative surface areas and current densities of the anode to the cathode in this process can vary from about 0.4 to about 2.0. The most preferred relationship is when the anode has about 2.5 times the surface area of the cathode.

In order to make the lead adhere readily to the cathode, the conditions should be adjusted so that dense rather than sponge lead is obtained. If sponge lead results, then the process must be run with bags surrounding the electrodes. That is inconvenient and has an adverse effect on the efficiency of the react In addition, the sponge lead is not commercially acceptable.

Dense lead is obtained when the current density is about 0.085 amps per square inch. When 0.100 amps per square inch is used, sponge lead is produced. The dense lead adheres reasonably well to the cathode, however, adherence can be improved if the cathode is etched with acid before being placed in the electrolysis tank.

The temperature of the electrolysis solution has an effect on the yields since, as the temperature goes up the yields increase until about 200° F., is reached, then the yields level off. It has been found that optimum yields result when the electrolyte solution is about 180° F. to 200° F., with about 180° F. preferred.

The longer the electrolysis is carried out, the higher the yield becomes until the amount of lead azide in the solution becomes too small, then more lead azide is added. The time to add lead azide is when the amount present is less than the capability of the process for removing lead. The pH of the electrolyte is maintained at about 13 to 13.5 throughout the electrolysis.

When all the optimum conditions discussed above are utilized, the amount of lead azide destroyed per hour in a large scale system described in Example 6 below is about 25 to 30 lbs., yielding about 17 to 21 lbs. of lead per hour.

Referring to FIG. 1, in which electrolysis tank 1 contains electrolyte 2, stainless steel crossbars 5 and 6 have attached thereto stainless steel electrodes 3 and 4. The center crossbar 6 has the cathode electrode 4 attached thereto and the two outer stainless steel crossbars 5 and 6 have an anode electrode 3 attached thereto. The crossbars 5 and 6 are connected at the wires 9 on the ends thereof to an electric power supply control, not shown.

The electrolyte 2 in the tank 1 is heated to the operative temperatures by the heater 8 in the tank 1. The lead azide is added to the electrolyte 2 to replenish the source of lead as the lead is deposited on the cathode 4, through the hoses 7. The electrolyte 2 is agitated by an agitator, not shown, and air which bubbles in through the inlet 10 at the bottom of the tank 1.

The following examples illustrate the invention.

EXAMPLE 1

A known amount of lead azide was placed in a beaker containing ten percent aqueous sodium hydroxide solution. Insoluble metal electrodes were immersed at opposite sides of the beaker and five volts were applied to the electrodes (DC) resulting in a current of 1.44 amperes. The cathode area was 3.5 square inches, resulting in a current density of 0.4 amps per square inch.

When the lead azide was partially dissolved, samples of the solution were taken to determine lead and azide ion concentrations. Lead content was determined using an atomic absorption spectrophotometer and azide ion levels were determined by infrared spectrophotometry. The samples of the electrolysis solution were taken at about 15 minute intervals until the lead concentration dropped below 1000 parts per million. At this point an additional increment of lead azide was added.

This cycle was repeated three times. At the end of the third cycle, the electrolysis solution was clear and contained only a small amount of metallic lead which had not adhered to the cathode.

The results are shown in the following tables.

TABLE I

Analysis Data of Lead and Azide Ion Concentration

I. Initial Conditions
Solution- 200 ml. of 10% sodium hydroxide
Electrode material- Platinum
Lead azide added- 5.7552 gms.
Electrolytic conditions- 5.0 volts, 1.4 amperes II. Cycle Information

| Time (min) | Pb (ppm.) | % $NaN_3$ | pH |
|---|---|---|---|
| Cycle No. 1 | | | |
| 0 | 10,000 | 1.95 | 13.20 |
| 15 | 4,500 | 1.57 | 13.05 |
| 30 | 3,250 | 1.35 | 13.20 |
| 45 | 2,250 | 0.80 | 13.20 |
| 60 | 2,250 | 1.05 | 13.10 |
| 99 | 875 | 0.25 | 13.20 |
| Cycle No. 2 4.6041 gms lead azide added; 3.2633 gms lead recovered | | | |
| 99 | 4,088 | 0.25 | 13.10 |
| 114 | 3,438 | 1.00 | 13.10 |
| 129 | 2,812 | 0.75 | 13.10 |
| 144 | 1,838 | 0.83 | 13.10 |

TABLE I-continued

Analysis Data of Lead and Azide Ion Concentration

I. Initial Conditions
Solution- 200 ml. of 10% sodium hydroxide
Electrode material- Platinum
Lead azide added- 5.7552 gms.
Electrolytic conditions- 5.0 volts, 1.4 amperes II. Cycle Information

| Time (min) | Pb (ppm.) | % $NaN_3$ | pH |
|---|---|---|---|
| 178 | 437 | 0.70 | 13.10 |
| 203 | 220 | 0.65 | 13.10 |
| Cycle No. 3 4.8486 gms lead azide added; 3.1432 gms lead recovered | | | |
| 203 | 2,212 | 1.60 | 13.20 |
| 218 | 3,288 | 0.40 | 13.20 |
| 252 | 1,088 | 0.95 | 13.30 |
| 267 | 838 | 0.53 | 13.30 |
| 304 | 288 | 0.70 | 13.30 |
| 347 | 220 | 0.45 | 13.25 |

At the end of the cycling 3.0342 gms of lead were recovered.

Figure 4:
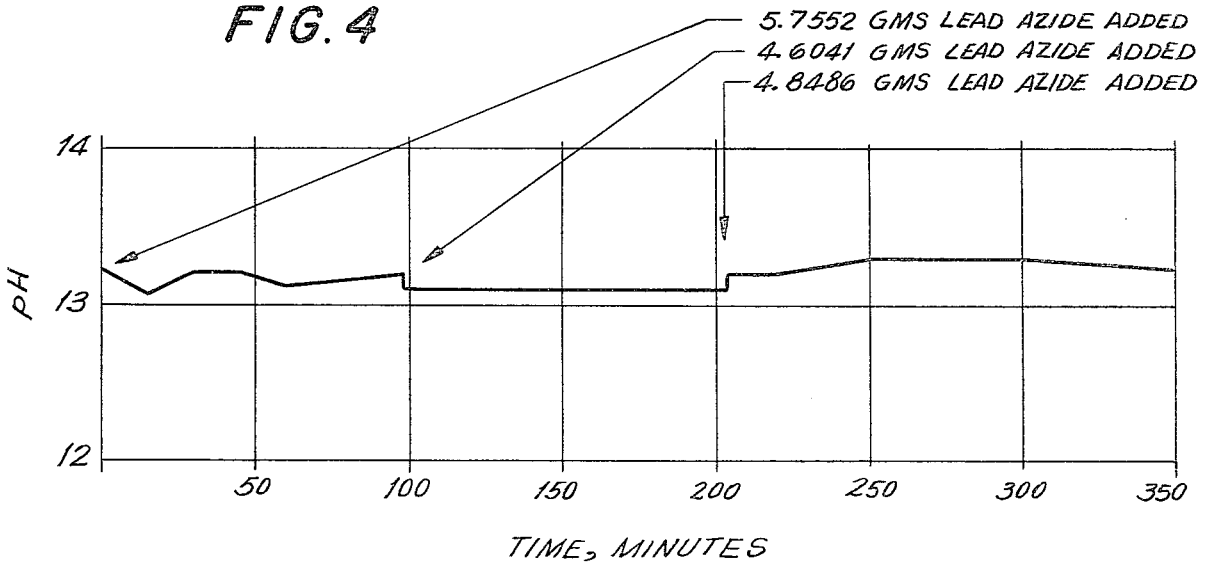
FIG. 4 is a graph illustrating the effect of time on the pH of the electrolysis solution.
Figure 2:
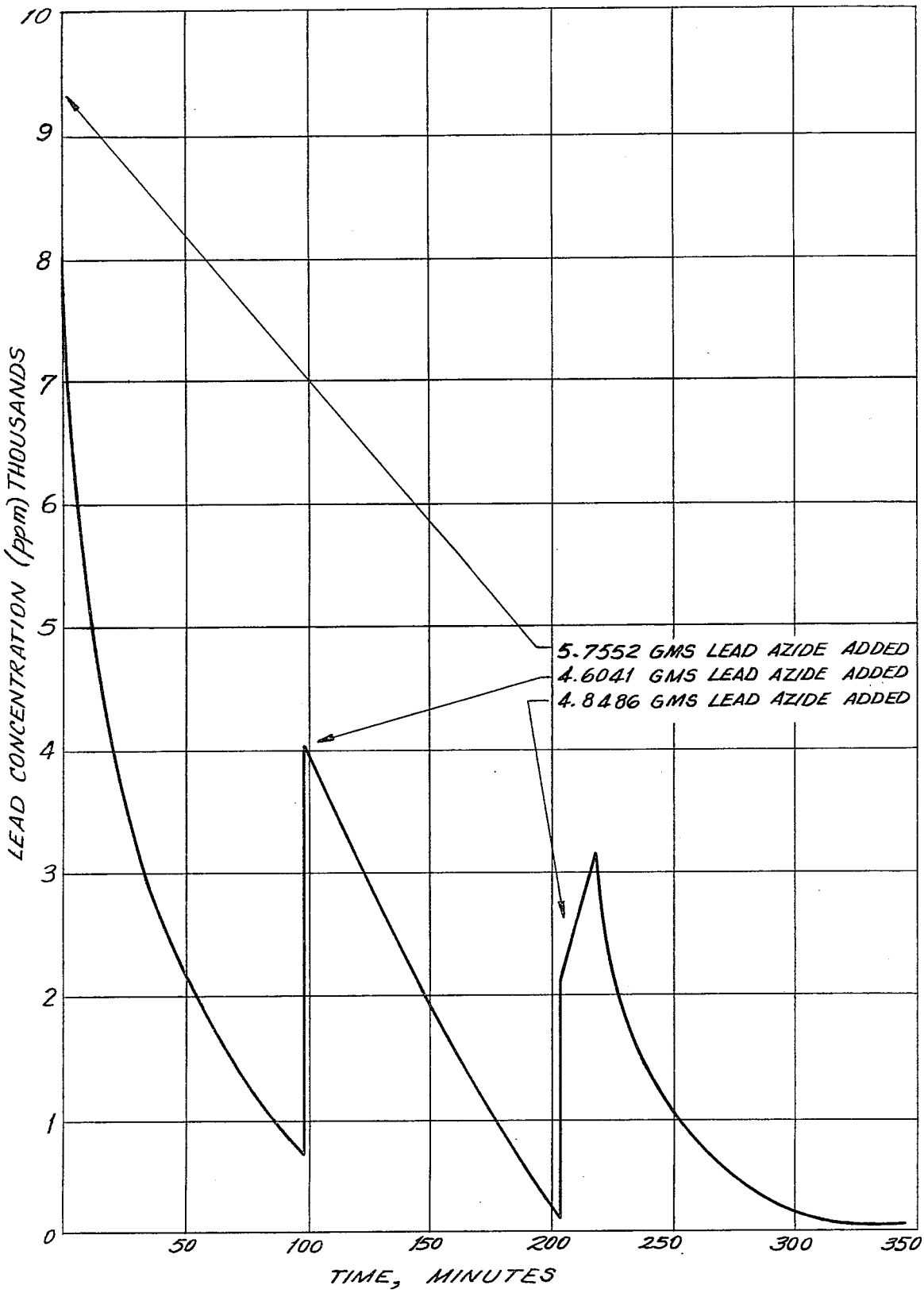
FIG. 2 is a graph illustrating the effect of time on the concentration of lead in the electrolysis solution.
Figure 3:
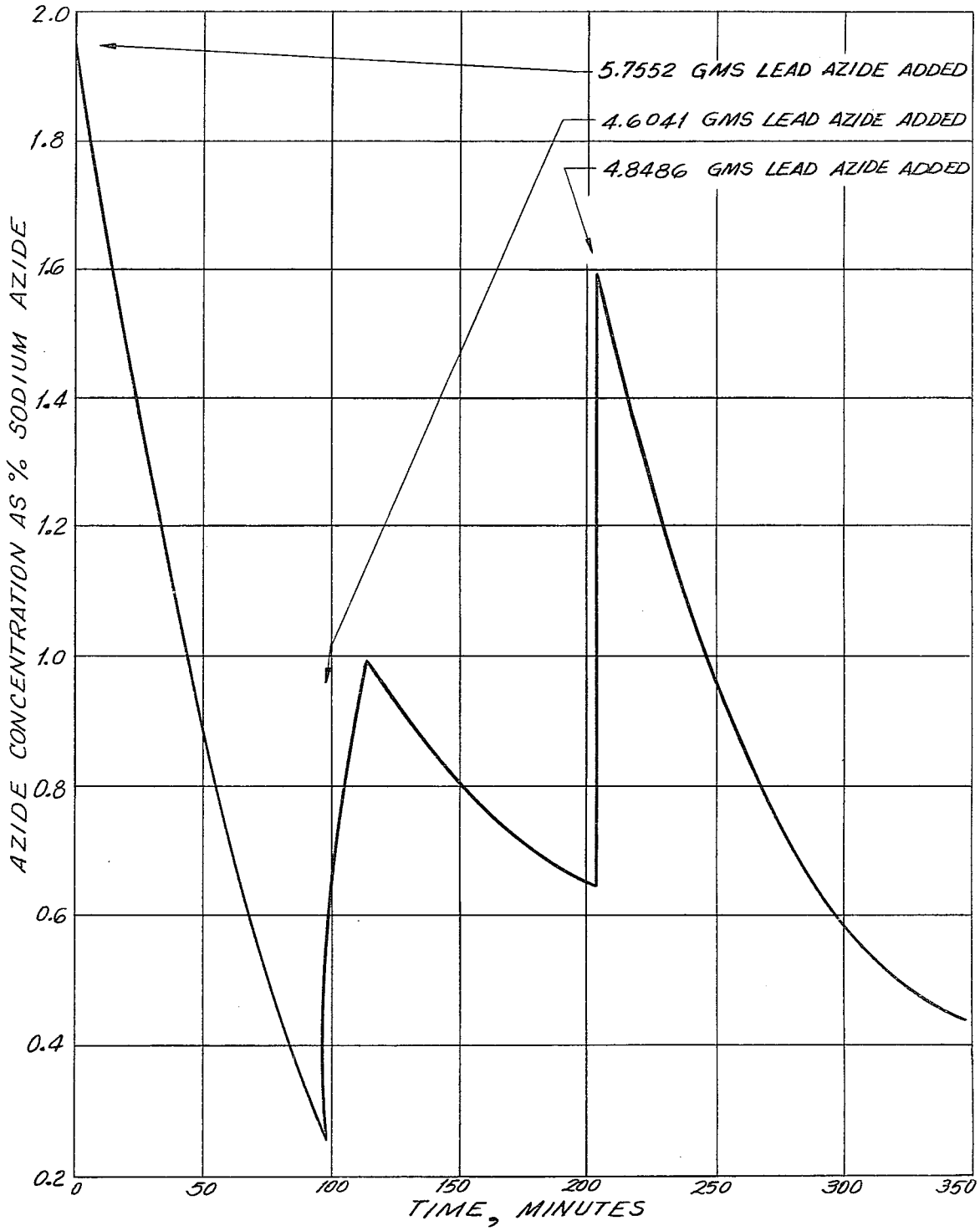
FIG. 3 is a graph illustrating the effect of time on the concentration of azide ion in the electrolysis solution.

As can be seen from Table 1 and the graphs depicted in FIGS. 2, 3, and 4 the concentration of the lead and azide ion decreased with time and was independent of pH which remained essentially unchanged.

TABLE 2

Recovery of Lead From Cathode

| Cycle No. | Lead azide added to 200 ml. sol. (gm) | Calc. additions as lead (gm) | Electrolysis time at 5V, 1.44 amps (min) | Solid Pb recov. fr. cathode (gm) | % Pb in sol rec. |
|---|---|---|---|---|---|
| 1 | 5.7552 | 4.0942 | 99 | 3.2633 | 79.7 |
| 2 | 4.6041 | 3.2754 | 104 | 3.1432 | 76.5 |
| 3 | 4.8486 | 3.4493 | 145 | 3.0340 | 68.8 |
| Totals | 15.2079 | 10.8189 | 348 | 9.4405 | 87.3 |

$$\% \text{ Recovery on Cathode} = \frac{9.4405}{10.8189} \times 100 = 87.3$$

TABLE 3

Lead Remaining in 200 ml. Solution

| Cycle No. | Ppm remaining in sol'n. after run | Wt. Pb in sol'n calc. from ppm (gm) | % of Pb remaining in solution |
|---|---|---|---|
| 1 | 875 | 0.1750 | 4.27 |
| 2 | 220 | 0.0440 | 0.60 |
| 3 | 220 | 0.0440 | 0.41 |

Table 2 contains data which show that the use of electrolysis under the conditions of this experiment results in the recovery of 87.3% of the amount of lead added to the electrolysis solution.

Table 3 contains data which show the amounts of lead remaining in the electrolysis solution.

EXAMPLE 2

A large scale experiment was set up to determine the operating parameters of the reaction as follows:

Stainless steel tanks of 18 gallon capacity thermostatically heated by steam-heated panel coils were used. The electrolysis bath was agitated by a stream of air bubbling from the bottom of the tank. Stainless steel bars were hung across the tank to serve as electrode support contacts. Connections to the contacts were made with flexible welding cable. Electrodes were stainless steel or lead strips.

The system was set up by filling the 18 gallon tank with a 10% sodium hydroxide solution to within three inches of the top. The electrode support bars were spaced four inches apart and parallel, with two anode bars flanking the cathode bar. Two pounds of lead azide were added, an ounce at a time. Two-inch wide strips of stainless steel were used for electrodes consisting of two anodes and one cathode.

Figure 5:
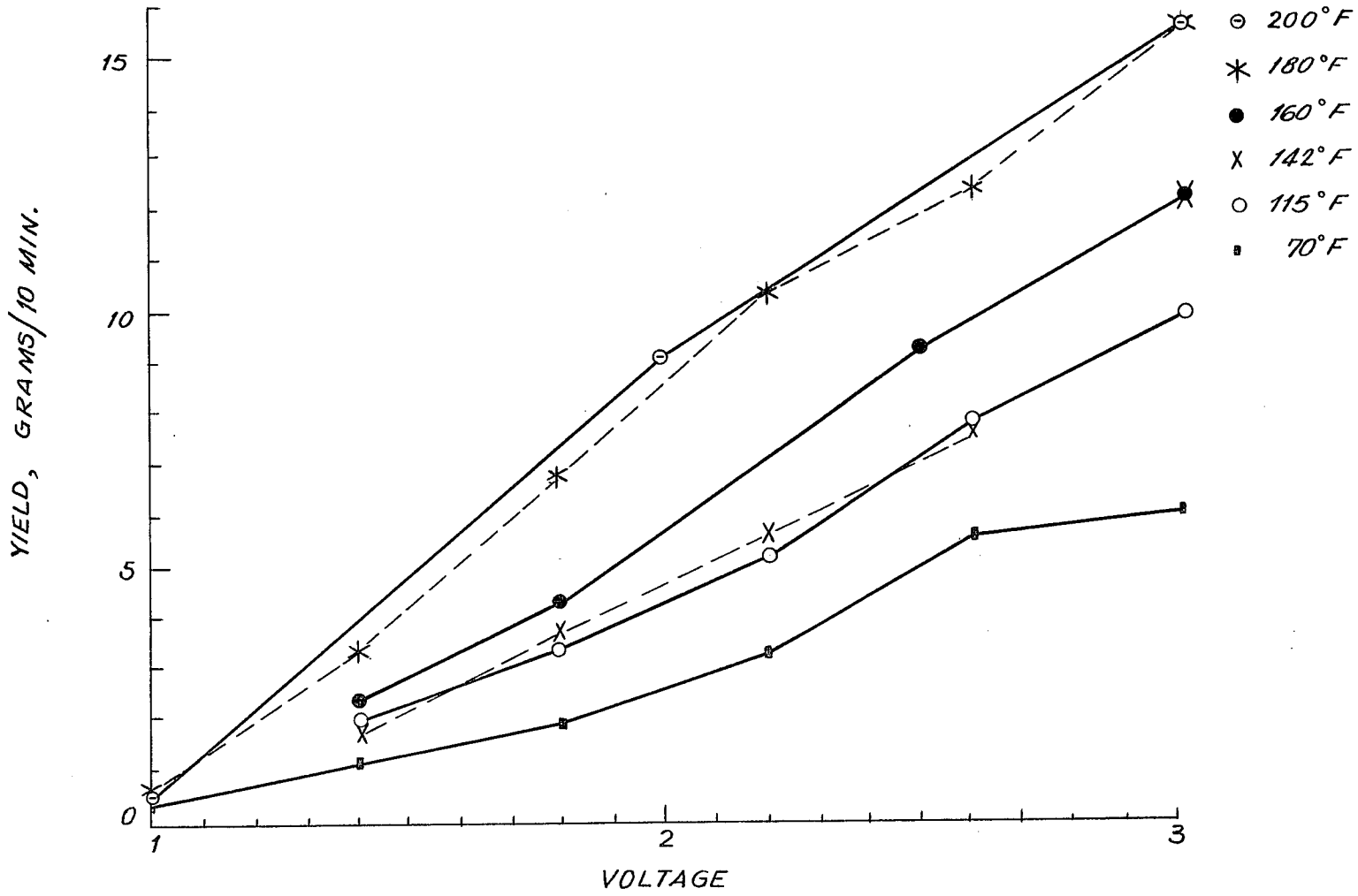
FIG. 5 is a graph illustrating the yield of electroplated lead as a function of electrode potential at different temperatures.
Figure 6:
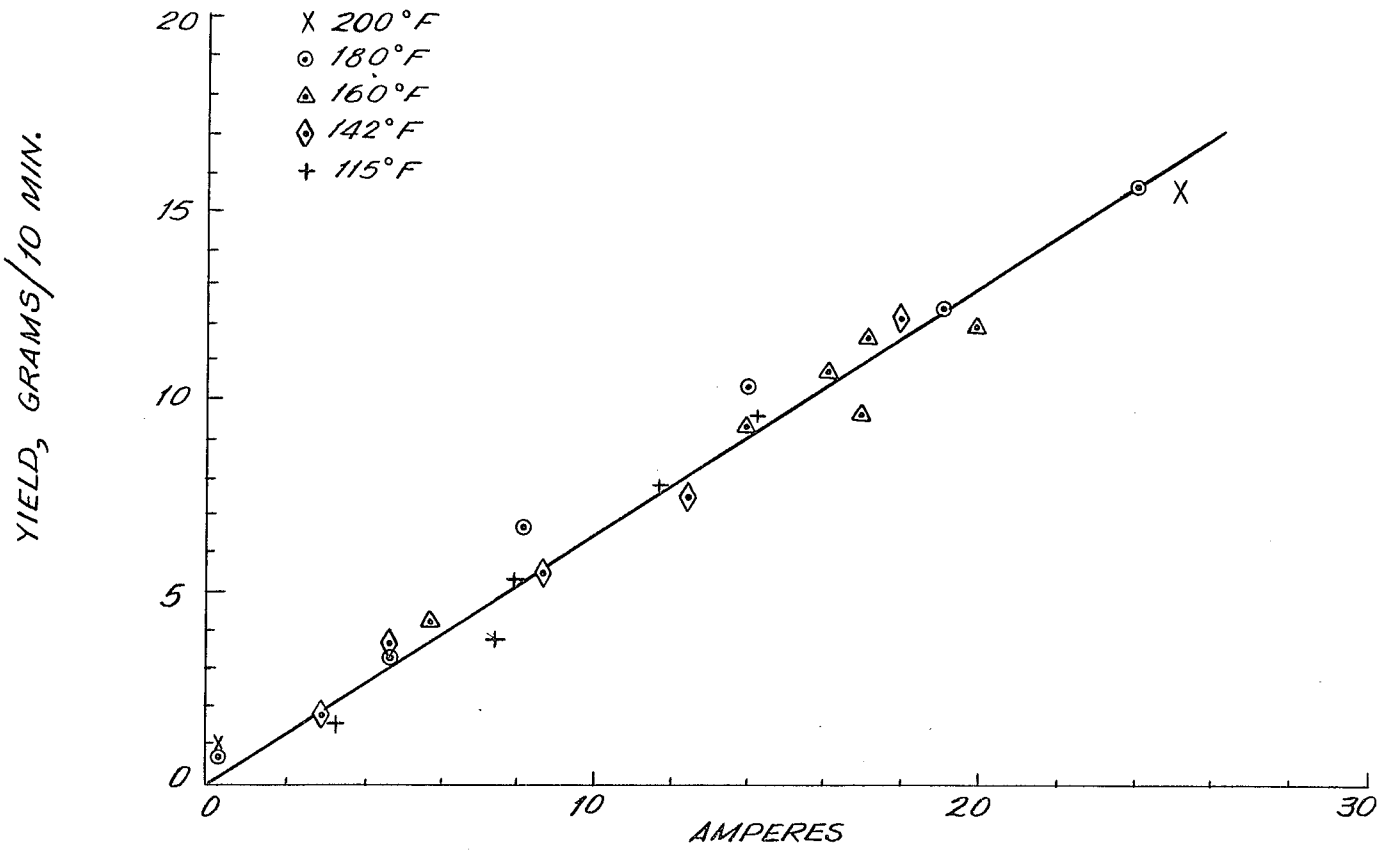
FIG. 6 is a graph illustrating the yield of electroplated lead as a function of current at different temperatures.

Electrolysis was performed at temperatures between room temperature, about 70° F., and about 200° F., and voltages of from about 1 to 3 with a current of about 0.5 amperes to about 25 amperes. The results, as shown in FIG. 5 indicate that yields of lead increased with increasing voltage and with the temperature of the electrolysis bath. There is a linear relationship between yield and current that is independent of temperature, as shown in FIG. 6.

The lead which plated out on the cathode adhered very poorly and was easily scraped off. Some of the lead detached itself from the electrode and fell to the bottom of the tank. It was necessary to put a catch container below the cathode to prevent lead from falling to the bottom of the tank.

The amount of lead recovered was 97% of theoretical, an electrochemical efficiency of 97%. Electrochemical efficiency was determined by dividing the actual yield per coulomb by the theoretical yield per coulomb.

The predominate physical form of the lead recovered was so called "sponge lead" which is a mass of interconnected fine crystals that take on a consistency somewhat like plumber's lead wool.

The remaining lead recovered was in the form of lead crystals.

EXAMPLE 3

Figure 7:
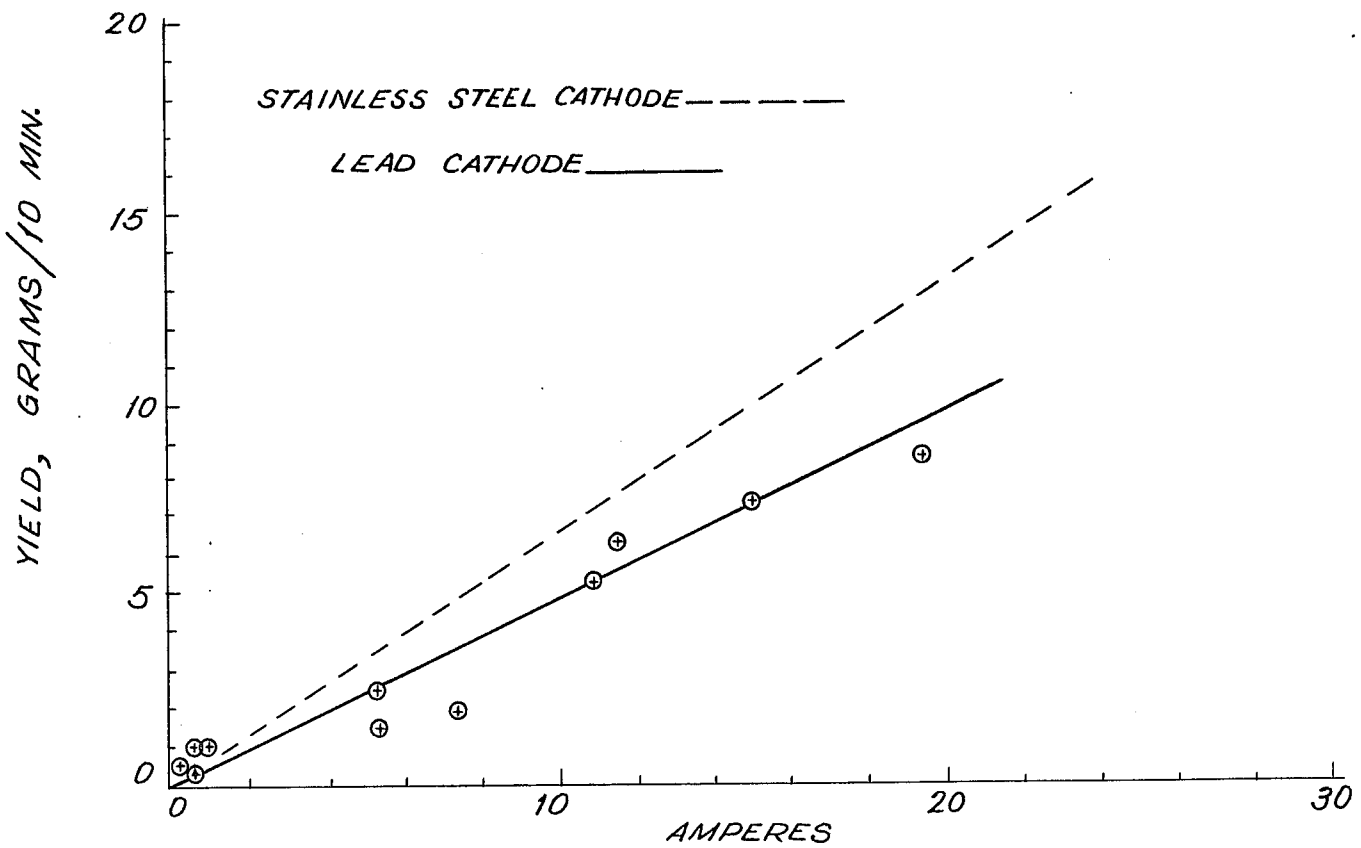
FIG. 7 is a graph illustrating the yield of electroplated lead as a function of current using a stainless steel cathode and a lead cathode.

The method of Example 2 was repeated utilizing lead cathodes. The yields, as illustrated in FIG. 7 were lower with lead cathodes than with stainless steel cathodes.

EXAMPLE 4

The method of Example 2 was repeated utilizing seven different combinations of anode and cathode surface areas and current densities. As shown in Table 4, the highest yield was obtained at a cathode current density of 0.47 amps. per square inch, for a total applied current of 75 amps. In all the experiments, the physical form of the lead deposited was of the sponge type.

TABLE 4

Current Density Versus Yield Data

| Experiment No. | 1 | 2 | 3 | 4 | 5 | 6 | 7 |
|---|---|---|---|---|---|---|---|
| Yield (Grams of Lead) | 3.835 | 8.287 | 22.314 | 24.592 | 24.810 | 26.053 | 27.304 |
| Amps | 7.5 | 20.0 | 47.5 | 76.0 | 75.0 | 75.0 | 75.0 |
| Voltage | 3.0 | 5.0 | 6.0 | 7.0 | 8.5 | 8.2 | 5.5 |
| Cathode Surface Area ($in^2$) | 40 | 40 | 80 | 120 | 160 | 160 | 160 |
| Anode Surface Area ($in^2$) | 40 | 40 | 80 | 120 | 160 | 80 | 400 |
| (A) Anode Current Density ($\frac{amp}{in^2}$) | 0.19 | 0.50 | 0.59 | 0.63 | 0.47 | 0.94 | 0.19 |

TABLE 4-continued

| Current Density Versus Yield Data | | | | | | | |
|---|---|---|---|---|---|---|---|
| Experiment No. | 1 | 2 | 3 | 4 | 5 | 6 | 7 |
| (C) Cathode Current Density ( $\frac{amp}{in^2}$ ) | 0.19 | 0.50 | 0.59 | 0.63 | 0.47 | 0.47 | 0.47 |
| (A/C) | 1.0 | 1.0 | 1.0 | 1.0 | 1.0 | 2.0 | 0.4 |

Note:In experiment 7, a cathode sandwiched between two anodes was used. In all other experiments a single cathode and a single anode were used.

EXAMPLE 5

An 18 gallon tank measuring 15"×15"×23" was filled to within 3" of the top with a 10% sodium hydroxide solution saturated with lead azide. The The operating temperature was 180° F. Three parallel stainless steel bars were suspended across the top of the tank, four inches apart. From the middle bar were suspended four two inch wide stainless steel strips which extended ten inches below the surface of the electrolysis solution.

Each of the other bars held five two inch wide stainless steel strips which also extended ten inches below the surface of the electrolysis solution. The outer two bars and their strips were the anode and the inner two bars and their strips were the cathode. Cotton bags were suspended below and around each set of electrode strips. The system was operated at 4.7 volts and 85 amperes for ten minutes, 37.5 grams of lead were recovered which is equivalent to 318 grams of lead azide decomposed per hour. In addition a small amount of lead oxide, $Pb_3O_4$, formed from an anodic oxidation and settled to the bottom of the tank.

EXAMPLE 6

1600 gallons of electrolyte containing 20% by weight sodium hydroxide, 5% by weight sodium-potassium tartrate and 0.2% rosin powder was prepared as follows:

Approximately one thousand gallons of water was added to the tank. The sodium hydroxide was added in two increments on successive days as the reaction is very exothermic. After the last addition of sodium hydroxide, the 5% sodium-potassium tartrate was added. The next working day the tank was heated up to 180° F. and the rosin was added. This added temperature is necessary to get the rosin in solution. When all the ingredients were in the tank, it was filled to within three inches of the top with water.

The tank had an air bubbler for agitation and stainless steel bars across the top to which stainless steel electrodes were attached. The electrodes were connected to the power supply of 3,000 amperes capacity. The power supply unit had means to vary the voltage between 0 and 9. The tank contained a heater to heat the electrolyte.

The electrolyte was heated to about 180° F.–190° F., then 553 pounds of lead azide as a solution in the electrolyte was added over a period of several days by pumping the hot electrolyte from the top of the tank to a vessel containing lead azide to form a solution thereof in the electrolyte, and allowing the resulting solution to flow from the vessel through a side outlet to the electrolysis tank. The power was turned on and the electrolysis was allowed to proceed. Twelve sets of conditions as set forth in the following Table 5 were run.

TABLE 5

ANALYSIS DATA FOR THE FIRST SET OF TEST RUNS WITH THE FULL SCALE SYSTEM

| Run No. | Time Hours | Volts | Amps | Yield Lead Lbs. | Lead Azide Destroyed | Lead Azide Destroyed per Hour | Quality of Lead | Total Lbs. Lead Azide Destroyed | Lbs. Lead Azide left in Tank | AMP/in$^2$ |
|---|---|---|---|---|---|---|---|---|---|---|
| 1 | 1 | 3 | 2825 | 20.7 | 29.1 | 29.1 | some sponge | 29.1 | 523.9 | .100 |
| 2 | 1 | 2.5 | 2385 | 17.7 | 24.9 | 24.9 | some panels didn't plate | 54.0 | 498.0 | .085 |
| 3 | 1 | 2.5 | 2385 | 20.4 | 28.7 | 28.7 | very good | 82.7 | 469.3 | .085 |
| 4 | 1 | 2.5 | 2385 | 20.2 | 28.4 | 28.4 | very good | 111.1 | 440.9 | .085 |
| 5 | 1 | 2.5 | 2385 | 20.1 | 28.3 | 28.3 | good | 139.4 | 412.6 | .085 |
| 6 | 1 | 2.5 | 2385 | 20.6 | 29.0 | 29.0 | fair | 168.0 | 383.6 | .085 |
| 7 | 1 | 2.5 | 2385 | 20.3 | 28.6 | 28.6 | some sponge | 196.6 | 355.0 | .085 |
| 8 | 1 | 2.4 | 1860 | 15.6 | 22.3 | 22.3 | fair | 218.9 | 332.7 | .066 |
| 9 | 1 | 2.4 | 1301 | 12.1 | 17.0 | 17.0 | good | 235.9 | 315.7 | .046 |
| 10 | 4.5 | 2.4 | 1301 | 49.9 | 70.2 | 15.6 | good to fair | 306.1 | 245.5 | .046 |
| 11 | 4.5 | 2.3 | 1083 | 41.6 | 58.5 | 13.0 | fair | 364.6 | 187.0 | .039 |
| 12 | 12.5 | N/A | 519 | 55.2 | 77.7 | 6.2 | fair | 440.9 | | |

The data in Table 5 indicate that highest yields per hour were obtained in runs 1 and 6 and that the best lead, i.e. little or no sponge lead, was obtained in runs 3,4,5,9 and 10.

We claim:

1. A process for producing metallic lead by the electrolysis of lead azide which comprises subjecting lead azide dissociated in an aqueous alkaline electrolyte in an electrolysis apparatus to electrolysis whereby the lead contained therein plates out at the cathode in the electrolysis apparatus.

2. The process of claim 1 wherein the cathode and anode electrodes in said electrolysis apparatus are selected from the group consisting of stainless steel, lead, platinum and copper.

3. The process of claims 1 or 2 wherein the cathode and the anode in said electrolysis apparatus are each stainless steel.

4. The process of claim 2 wherein the electrolyte contains on a weight basis, 20% sodium or potassium hydroxide.

5. The process of claim 4 wherein said electrolyte, in addition contains on a weight basis, from about 0.2% to about 0.6% rosin and about 5% sodium-potassium tartrate.

6. The process of claim 5 wherein said electrolyte is sodium hydroxide.

7. The process of claim 2 wherein the current density applied to said electrodes is from about 0.046 to about 0.100 amps per square inch.

8. The process of claim 2 wherein the voltage applied is from about 2.0 to about 8.5.

9. The process of claim 8 wherein the voltage applied is from about 2.3 to about 3.0.

10. The process of claim 2 wherein the lead recovered at the cathode is dense crystalline lead.

11. The process of claim 2 wherein the cathodes are etched with acid so that the lead is plated thereto with enhanced adherence.

12. The process of claim 1 wherein the temperature of the electrolyte is about 180° F. to about 200° F.

13. The process of claim 1 wherein the area of the anode per uni area of the cathode in the electrolysis apparatus is about 0.4 to about 2.

14. The process of claim 1 wherein the electrolysis apparatus contains two anodes per cathode.

15. The process of claim 1 wherein the pH of the electrolyte is about 13 to about 13.5.

16. A method of producing dense metallic lead by electrolysis of lead azide which comprises;

(a) dissolving lead azide in an aqueous alkaline electrolyte in an electrolysis apparatus, said aqueous alkaline electrolyte being at pH about 13–13.5 and containing on a weight basis, 20% sodium hydroxide, 5% sodium-potassium tartrate and 0.2% rosin, (b) inserting stainless steel electrodes in the apparatus, wherein the area of the anode per unit area of the cathode is about 0.4 to 2.0, (c) heating the electrolyte to about 180° F.–200° F., (d) applying from about 2.0 to about 8.5 volts and a current density of about 0.046 to about 0.085 amps per square inch of electrode for a time sufficient to plate the lead in the lead azide onto the cathode electrode, and (e) recovering the lead from the cathode.

17. The process of claim 1 wherein the cathode is acid etched.

* * * * *